US009161132B2

(12) United States Patent
Sunaga

(10) Patent No.: US 9,161,132 B2
(45) Date of Patent: Oct. 13, 2015

(54) AUDIO PROCESSING APPARATUS WITH SELECTION TO AND FROM MULTI-ROOM MODE

(75) Inventor: Tadaharu Sunaga, Osaka (JP)

(73) Assignee: Onkyo Corporation, Neyagawa-shi (JP)

( * ) Notice: Subject to any disclaimer, the term of this patent is extended or adjusted under 35 U.S.C. 154(b) by 983 days.

(21) Appl. No.: 13/287,258

(22) Filed: Nov. 2, 2011

(65) Prior Publication Data

US 2012/0183147 A1 Jul. 19, 2012

(30) Foreign Application Priority Data

Jan. 18, 2011 (JP) ..... 2011-007989

(51) Int. Cl.

| | |
|---|---|
| ***H04R 5/04*** | (2006.01) |
| ***H04S 1/00*** | (2006.01) |
| ***H04S 3/00*** | (2006.01) |

(52) U.S. Cl.

CPC *H04R 5/04* (2013.01); *H04S 1/007* (2013.01); *H04S 3/008* (2013.01); *H04R 2227/005* (2013.01); *H04R 2420/01* (2013.01); *H04R 2430/01* (2013.01); *H04S 2400/03* (2013.01); *H04S 2400/13* (2013.01)

(58) Field of Classification Search

CPC ..... H04H 60/04; H04R 5/04; H04R 2420/03; H04R 2227/005; H04R 2430/01; H04R 2420/01; H04S 1/007; H04S 3/008; H04S 2400/03; H04S 2400/13

USPC ..... 381/123, 81, 80, 333

See application file for complete search history.

(56) References Cited

U.S. PATENT DOCUMENTS

| | | | |
|---|---|---|---|
| 6,430,353 | B1 | 8/2002 | Honda et al. |
| 6,665,645 | B1 | 12/2003 | Ibaraki et al. |
| 7,006,645 | B2 | 2/2006 | Fujita et al. |
| 2009/0060227 | A1 | 3/2009 | Kanoh et al. |

FOREIGN PATENT DOCUMENTS

| | | |
|---|---|---|
| JP | 03-270600 | 12/1991 |
| JP | 4-53399 | 5/1992 |
| JP | 2001-100785 | 4/2001 |
| JP | 2002-374600 | 12/2002 |
| JP | 2004-056418 | 2/2004 |
| JP | 2009-044257 | 2/2009 |
| JP | 2009-044685 | 2/2009 |

*Primary Examiner* — Vivian Chin
*Assistant Examiner* — Douglas Suthers
(74) *Attorney, Agent, or Firm* — Renner, Otto, Boisselle & Sklar, LLP

(57) ABSTRACT

An audio processing section generates at least a left-front audio signal, a right-front audio signal, a second left audio signal that is the same as a left-front audio signal, and a second right audio signal that is the same as the right-front audio signal based on a left-front audio signal and a right-front audio signal supplied from an audio selector, and outputs these signals to a main output terminal, and supplies the second left audio signal and the second right audio signal also to a switch section. When a first mode is selected, the switch section selects the audio signal from the audio processing section, and supplies it to a ZONE2 output terminal. On the other hand, when modes other than the first mode are selected, the switch section selects an audio signal from the audio selector, and supplies the selected audio signal to the ZONE2 output terminal.

5 Claims, 11 Drawing Sheets

AUDIO PROCESSING APPARATUS WITH SELECTION TO AND FROM MULTI-ROOM MODE

BACKGROUND OF THE INVENTION

1. Field of the Invention

The present invention relates to an audio processing apparatus having a first output terminal for outputting an audio signal to a first speaker arranged in a first room, and a second output terminal for outputting an audio signal to a second speaker arranged in a second room.

2. Description of the Related Art

FIG. 11 is a block diagram illustrating a constitution of a conventional AV amplifier 101. The AV amplifier 101 is connected to a plurality of BD (Blu-Ray Disc) players 20A and 20B. Digital audio signals are input from the BD players 20A and 20B into digital audio input terminals IN1 and IN2, and analog audio signals are input into analog audio input terminals IN3 and IN4. The AV amplifier 101, BD players 20A and 20B, and a main speaker 30 are arranged in a main room, and a ZONE2 speaker 40 is arranged in a ZONE2 room.

An audio signal to be output to the main speaker 30 will be described. A digital audio selector 2 selects one digital audio signal from digital audio signals supplied from the BD players 20A and 20B, and supplies this signal to a DSP 6. An analog audio selector 3 selects one analog audio signal from analog audio signals supplied from the BD players 20A and 20B, and supplies this signal to an ADC 5. The ADC 5 converts the analog audio signal into a digital audio signal, and supplies the digital audio signal to the DSP 6. Actually, only the digital audio signal from any one of the digital audio selector 2 and the analog audio selector 3 is supplied to the DSP 6. The DSP 6 executes an audio process on the supplied digital audio signal, and supplies the processed signal to a DAC 7. The DAC 7 converts the supplied digital audio signal into an analog audio signal, and supplies the converted signal to an amplifying section 8. The amplifying section 8 amplifies the supplied audio signal, and outputs the audio signal to the main speaker 30 via a speaker output terminal 9 for the main speaker.

An audio signal to be output to the ZONE2 speaker 40 will be described. An analog audio selector 4 selects one analog audio signal from analog audio signals supplied from the BD players 20A and 20B, and supplies the selected signal to an amplifying section 10. The amplifying section amplifies the supplied audio signal, and outputs the amplified audio signal to the ZONE2 speaker 40 via a speaker output terminal 11 for the ZONE2 speaker. Only an analog audio signal from the analog audio selector 4 can be output to the ZONE2 speaker 40, and thus digital audio signals input into the digital audio input terminals IN1 and IN2 cannot be output from the ZONE2 speaker 40.

The main room is, for example, a living room, and the ZONE2 room is a room adjacent to the living room (for example, a child room or a kitchen). Doors between these rooms are opened, and the main room and the ZONE2 room are occasionally used as one big room. At this time, it is assumed that the same audio signals from the BD player 20A or 20B are output as BGM to the main speaker to be arranged in the main room and the ZONE2 speaker to be arranged in the ZONE2 room. However, the audio signal to be output to the main speaker 30 is subject to the audio process in the DSP 6, and the audio signal to be output to the ZONE2 speaker 40 is not subject to the audio process in the DSP. For this reason, the audio signal to be output to the main speaker 30 is delayed by the time for the audio process in the DPS 6 with respect to the audio signal to be output to the ZONE2 speaker 40. As a result, the audio signal to be output from the main speaker 30 and the audio signal to be output from the ZONE2 speaker 40 are not output simultaneously, thereby providing a sense of discomfort to listeners.

In order to solve this problem, the following method is present. In this method, the analog audio signal to be supplied from the analog audio selector 3 is supplied directly to the amplifying section 8 without via the ADC 5, the DSP 6 and the DAC 7, so as to be output to the main speaker 30. In this case, however, the DSP 6 cannot generate surround audio signals (for example, a central audio signal C, a surround left audio signal SL, a surround right audio signal SR, and a lowpass audio signal SW) based on analog audio signals including a left-front audio signal L and a right-front audio signal R. For this reason, an audio cannot be output from speakers of these channels in the main speaker 30.

SUMMARY OF THE INVENTION

It is an object of the present invention to provide an audio processing apparatus in which, when the same audio signals are output to a first speaker arranged in a first room and a second speaker arranged in a second room, the audio signal to be output to the first speaker is prevented from being delayed with respect to the audio signal to be output to the second speaker.

An audio processing apparatus comprises: a mode selecting section for selecting one mode from a plurality of modes including a first mode according to a user's operation; a plurality of audio input terminals; a first output terminal for outputting an audio signal to a first speaker arranged in a first room; a second output terminal for outputting an audio signal to a second speaker arranged in a second room; a first selecting section for selecting one audio signal from audio signals input into the plurality of audio input terminals and supplying the selected audio signal to an audio processing section; a second selecting section for selecting one audio signal from the audio signals input into the plurality of audio input terminals and supplying the selected audio signal to a third selecting section; the audio processing section for generating at least a first left audio signal, a first right audio signal, a second left audio signal that is the same as the first left audio signal, and a second right audio signal that is the same as the first right audio signal based on the first left audio signal and the first right audio signal supplied from the first selecting section so as to output these signals to the first output terminal, and supplying the second left audio signal and the second right audio signal to the third selecting section; the third selecting section for selecting one of an audio signal from the second selecting section and an audio signal from the audio processing section, and outputting the selected audio signal to the second output terminal; and a control section for, when the first mode is selected, causing the third selecting section to select the audio signal from the audio processing section, and when modes other than the first mode are selected, causing the third selecting section to select the audio signal from the second selecting section.

When the first mode is selected, the third selecting section selects a second left audio signal and a second right audio signal from the audio processing section, and outputs them to the second output terminal. Since the audio signal from the audio processing section is output also to the first output terminal, when the same audio signals are output to the first speaker arranged in the first room and the second speaker arranged in the second room, the audio signal to be output to the first speaker can be prevented from being delayed with respect to the audio signal to be output to the second speaker.

An audio processing apparatus comprises: a mode selecting section for selecting one mode from a plurality of modes including a first mode according to a user's operation; a plurality of audio input terminals; a first output terminal for outputting an audio signal to a first speaker arranged in a first room; a second output terminal for outputting an audio signal to a second speaker arranged in a second room; a first selecting section for selecting one audio signal from audio signals input into the plurality of audio input terminals, and supplying the selected audio signal to an audio processing section; a second selecting section for selecting one audio signal from the audio signals input into the plurality of audio input terminals, and supplying the selected audio signal to a third selecting section; the audio processing section for generating at least a first left audio signal, a first right audio signal, a second left audio signal that is the same as the first left audio signal, and a second right audio signal that is the same as the first right audio signal based on the first left audio signal and the first right audio signal supplied from the first selecting section so as to output these audio signals to the first output terminal, and supplying the first left audio signal and the first right audio signal to the third selecting section; the third selecting section for selecting one of the audio signal from the second selecting section and the audio signal from the audio processing section, and outputting the selected audio signal to the second output terminal; and a control section for, when the first mode is selected, causing the third selecting section to select the audio signal from the audio processing section, and when modes other than the first mode are selected, causing the third selecting section to select the audio signal from the second selecting section.

When the first mode is selected, the third selecting section selects a first left audio signal and a first right audio signal from the audio processing section, and outputs them to the second output terminal. Since the audio signal from the audio processing section is output also to the first output terminal, when the same audio signals are output to the first speaker arranged in the first room and the second speaker arranged in the second room, the audio signal to be output to the first speaker can be prevented from being delayed with respect to the audio signal to be output to the second speaker.

An audio processing apparatus comprises: a mode selecting section for selecting one mode from a plurality of modes including a first mode according to a user's operation; a plurality of audio input terminals; a first output terminal for outputting an audio signal to a first speaker arranged in a first room; a second output terminal for outputting an audio signal to a second speaker arranged in a second room; an audio processing section for executing an audio process on a supplied audio signal; a first selecting section for selecting one audio signal from audio signals input into the plurality of audio input terminals; a multi-channel audio generating section for generating at least a first left audio signal, a first right audio signal, a second left audio signal that is the same as the first left audio signal, and a second right audio signal that is the same as the first right audio signal based on the first left audio signal and the first right audio signal supplied from the first selecting section, and outputting these signals to the first output terminal; a second selecting section for selecting one audio signal from the audio signals input into the plurality of audio input terminals, and outputting the selected audio signal to the second output terminal; a third selecting section for switching whether the audio signal from the audio processing section is output to the first output terminal or the audio signal from the multi-channel audio generating section is output to the first output terminal; and a control section for, when the first mode is selected, causing the first selecting section and the second selecting section to select the same audio signals and causing the third selecting section to output the audio signal from the multi-channel audio generating section to the first output terminal, and when modes other than the first mode are selected, causing the third selecting section to output the audio signal from the audio processing section to the first output terminal.

When the first mode is selected, the audio signal from the multi-channel audio generating section is output to the first output terminal without via the audio processing section. Since the audio signal is output also to the second output terminal without via the audio processing section, when the same audio signals are output to the first speaker arranged in the first room and the second speaker arranged in the second room, the audio signal to be output to the first speaker can be prevented from being delayed with respect to the audio signal to be output to the second speaker.

DETAILED DESCRIPTION OF THE PREFERRED EMBODIMENTS

Figure 1:
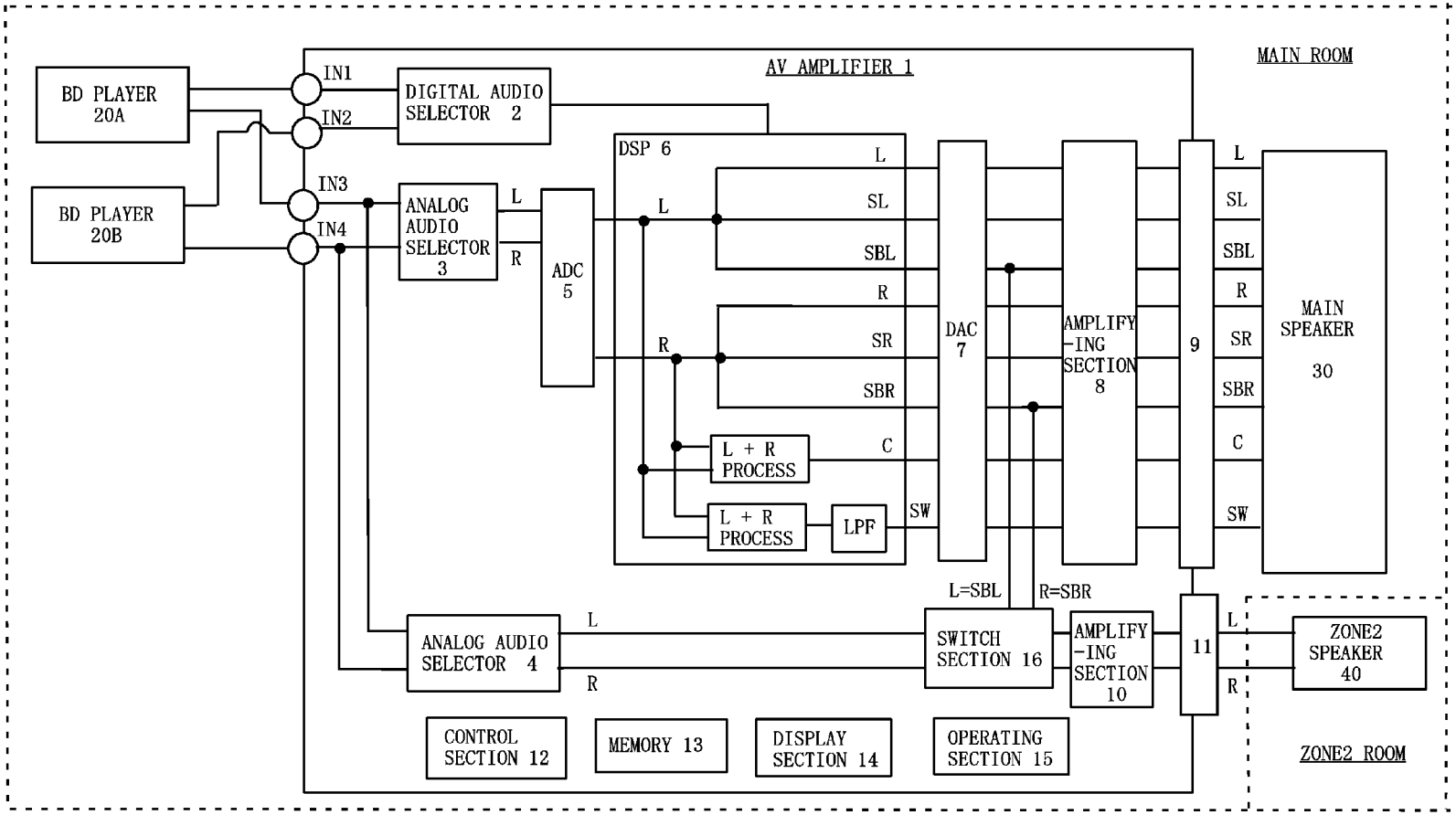
FIG. 1 is a block diagram illustrating a constitution of an AV amplifier 1 according to a preferred embodiment of the present invention.

An AV amplifier (audio processing apparatus) according to a preferred embodiment of the present invention will be concretely described below with reference to the drawings, but the present invention is not limited to the embodiment. FIG. 1 is a schematic block diagram illustrating an AV amplifier 1. In the AV amplifier 1, BD players (contents reproducing apparatuses) 20A and 20B are connected with digital audio input terminals IN1 and IN2 and analog audio input terminals IN3 and IN4, and a main speaker (a first speaker) 30 is connected with a speaker output terminal 9, and a ZONE2 speaker (a second speaker) 40 is connected with a speaker output terminal 11. The AV amplifier 1, the BD players 20A and 20B and the main speaker 30 are arranged in a main room (a first room), and the ZONE2 speaker 40 is arranged in a ZONE2 room (a second room). Doors between the main room and the ZONE2 room are closed so that these rooms can be blocked, and the doors are opened so that the rooms can be opened. The AV amplifier 1 may be further provided with signal paths and speaker output terminals for another rooms such as a ZONE3 room and a ZONE4 room.

Figure 2:
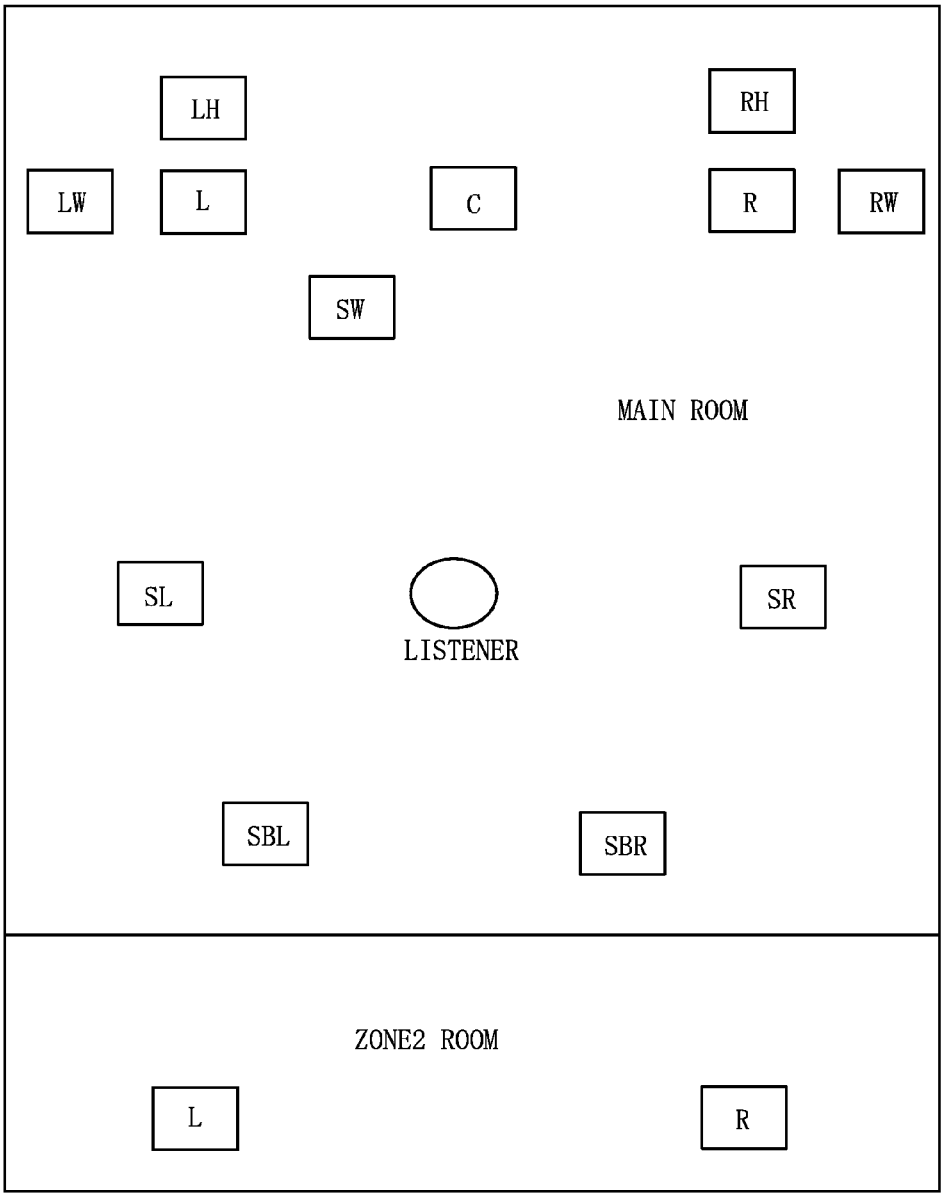
FIG. 2 is a diagram illustrating a layout of speakers of respective channels.

As shown in FIG. 2, the main speaker includes, but not limited to, speakers of 7.1 channels (for example, a left-front audio signal L, a right-front audio signal R, a central audio signal C, a surround left audio signal SL, a surround right audio signal SR, a lowpass audio signal SW, a surround left-rear audio signal SBL, and a surround right-rear audio signal SBR). Instead of (or in addition to) the surround left-rear audio signal SBL and the surround right-rear audio signal SBR, speakers may be provided for a left-outside audio signal LW, a right-outside audio signal RW, or an upper-left audio signal LH and an upper-right audio signal RH. The ZONE2 speaker includes speakers of 2 channels (for example, the left-front audio signal L and right-front audio signal R). The surround left-rear audio signal SBL is an audio signal to be reproduced on a position that is left-rear side of a user. The surround right-rear audio signal SBR is an audio signal to be reproduced on a position that is right-rear side of the user. The left-outside audio signal LW is an audio signal to be reproduced on a position that is the outside (left side) of the left-front audio signal L (namely, the left-front outside of the user). The right-outside audio signal RW is an audio signal to be reproduced on a position that is the outside (right side) of the right-front audio signal R (namely, the right-front outside of the user). The upper-left audio signal LH is an audio signal to be reproduced on a position that is the upper side of the left-front audio signal L (namely, the left-front upper side of the user). The upper-right audio signal RH is an audio signal to be reproduced on a position that is the upper side of the right-front audio signal R (namely, the right-front upper side of the user).

The left-front audio signal L is defined as a first left audio signal, and the right-front audio signal R is defined as a first right audio signal. The surround left audio signal SL, the surround left-rear audio signal SBL, the left-outside audio signal LW and the upper-left audio signal LH are defined as second left audio signals. The surround right audio signal SR, the surround right-rear audio signal SBR, the right-outside audio signal RW and the upper-right audio signal RH are defined as second right audio signals.

The AV amplifier 1 is provided with a plurality of listening modes, and the DSP 6 executes a predetermined audio process on a digital audio signal according to one listening mode selected by a user's operation. In this example, as the listening mode, a Whole House Mode (compatible with a first mode of the present invention) is provided. The Whole House Mode is suitable for a case where the doors between the main room and the ZONE2 room are opened so that the respective rooms are opened, and the same audio signals are reproduced from the main speaker 30 and the ZONE2 speaker 40. In the Whole House Mode, an audio signal that is subject to the audio process in the DSP 6 is output also to the ZONE2 speaker 40 similarly to the main speaker 30, so that the audio signal to be output to the main speaker 30 is prevented from being delayed with respect to the audio signal to be output to the ZONE2 speaker 40.

The AV amplifier 1 generally includes the digital audio input terminals IN1 and IN2, the analog audio input terminals IN3 and IN4, the digital audio selector 2, the analog audio selectors 3 and 4, an A/D converter (hereinafter, ADC) 5, the DSP 6, a D/A converter (hereinafter, DAC) 7, an amplifying section 8, the speaker output terminal 9 for the main speaker 30, an amplifying section 10, the speaker output terminal 11 for the ZONE2 speaker 40, a control section 12, a memory 13, a display section 14, an operating section 15, and a switch section 16.

The digital audio input terminal IN1 is connected with a digital audio output terminal of the BD players 20A, and a digital audio signal is input thereinto from the BD player 20A. The digital audio input terminal IN2 is connected with a digital audio output terminal of the BD player 20B, and a digital audio signal is input thereto from the BD player 20B. The analog audio input terminal IN3 is connected with an analog audio output terminal of the BD player 20A, and an analog audio signal is input thereinto from the BD player 20A. The analog audio input terminal IN4 is connected with an analog audio output terminal of the BD player 20B, and an analog audio signal is input thereinto from the BD player 20B.

The digital audio selector 2 selects one digital audio signal from a digital audio signal input into the digital audio input terminal IN1 and a digital audio signal input into the digital audio input terminal IN2 according to a user's operation, and supplies the selected signal to the DSP (the audio processing section) 6.

The analog audio selector 3 selects one analog signal from 2-channel analog audio signals (the left-front audio signal L and the right-front audio signal R) input into the analog audio input terminal IN3 and 2-channel analog audio signals (the left-front audio signal L and the right-front audio signal R) input into the analog audio input terminal IN4 according to a user's operation, and supplies the selected signal to the ADC 5. The ADC 5 converts the analog audio signal supplied from the analog audio selector 3 into a digital audio signal, and supplies the converted signal to the DSP 6.

Actually, only one digital audio signal that is selected from the digital audio signal supplied from the digital audio selector 2 and the digital audio signal supplied from the analog audio selector 3 via the ADC 5 by a user's operation is supplied to the DSP 6.

The DSP 6 executes a predetermined audio process on the digital audio signal supplied from the digital audio selector 2 or the ADC 5 according to the listening mode selected by a user's operation, and supplies the processed signal to the DAC 7. The predetermined audio process is, for example, a delay process, an equalizer process, and a reverberation process.

In the Whole House Mode, the analog audio signal selected by the analog audio selector 3 is converted into a digital audio signal by the ADC 5 so as to be supplied to the DSP 6. The DSP 6 generates the left-front audio signal L, the right-front audio signal R, and the surround audio signals (for example, the central audio signal C, the surround-left audio signal SL, the surround-right audio signal SR, the lowpass audio signal SW, the surround left-rear audio signal SBL and the surround right-rear audio signal SBR) based on the 2-channel audio signals including the left-front audio signal L and the right-front audio signal R.

More specifically, the surround left audio signal SL and the surround left-rear audio signal SBL are audio signals (copied audio signals) that are the same as the left-front audio signal L. The surround right audio signal SR and the surround right-rear audio signal SBR are audio signals (copied audio signals) that are the same as the right-front audio signal R. The central audio signal C is an audio signal that is generated by adding the left-front audio signal L and the right-front audio signal R. The lowpass audio signal SW is an audio signal that is generated by adding the left-front audio signal L and the right-front audio signal R and extracting only a lowpass component via LPF. These audio signals may be subject to slight adjustment of volume levels and delay times as the need arises, and the audio signals and the adjusted signals are defined as the same signals. In FIG. 1, a wiring described in the DSP 6 schematically illustrates an internal software process in the DSP 6.

Figure 3:
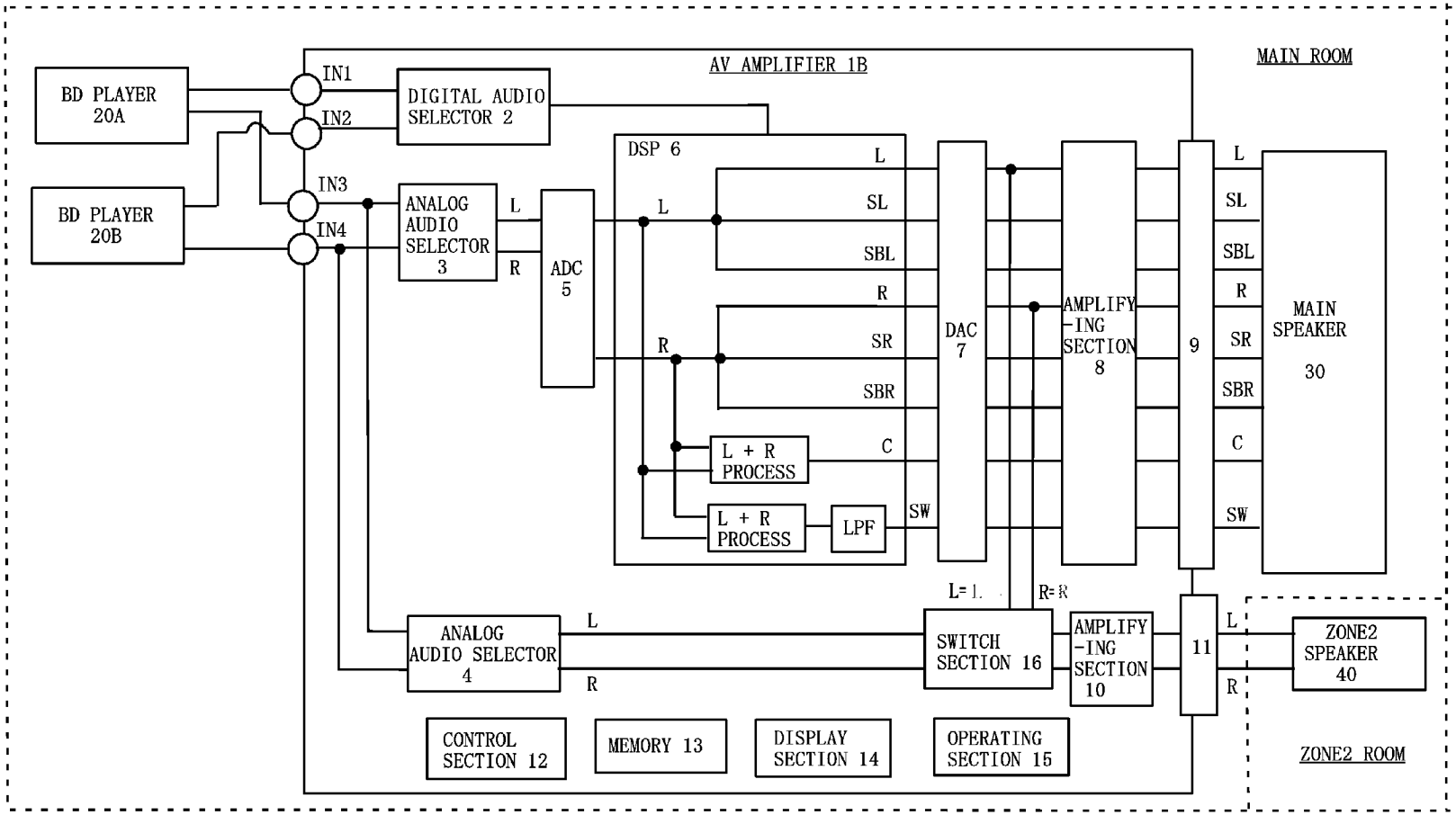
FIG. 3 is a block diagram illustrating a constitution of an AV amplifier 1B according to the preferred embodiment of the present invention.

The DAC 7 DA-converts the digital audio signal supplied from the DSP 6 into an analog audio signal, and supplies the converted signal to the amplifying section 8. The amplifying section 8 amplifies the audio signal supplied from the DAC 7, and outputs the amplified signal to the main speaker 30 via the speaker output terminal 9. The DAC 7, the amplifying section 8, and the speaker output terminal 9 are provided for 7.1 channels. The DAC 7 supplies the surround left-rear audio signal SBL and the surround right-rear audio signal SBR in the plural-channel audio signals to the switch section 16. This is because the surround left-rear audio signal SBL and the surround right-rear audio signal SBR are used as the left-front audio signal L and the right-front audio signal R for the ZONE2. As shown in FIG. 3, the DAC 7 may supply the left-front audio signal L and the right-front audio signal R to the switch section 16, or may supply, but not shown, the surround left audio signal SL and the surround right audio signal SR to the switch section 16.

The analog audio selector 4 selects one analog audio signal (the left-front audio signal L and the right-front audio signal R) from the analog audio signal input into the analog audio input terminal IN3 and the analog audio signal input into the analog audio input terminal IN4 according to a user's operation, and supplies the selected signal to the switch section 16.

The switch section 16 selects one analog audio signal from the analog audio signal supplied from the analog audio selector 4 and the analog audio signal supplied from the DAC 7 according to an instruction from the control section 12, and supplies the selected signal to the amplifying section 10. When the analog audio signal supplied from the DAC 7 is selected, the surround left-rear audio signal SBL is used as the left-front audio signal L for the ZONE2, and the surround right-rear audio signal SBR is used as the right-front audio signal R for the ZONE2.

The amplifying section 10 amplifies the audio signal supplied from the switch section 16, and outputs the audio signal to the ZONE2 speaker 40 via the speaker output terminal 11. The amplifying section 10 and the speaker output terminal 11 are provided typically for the left-front audio signal L and the right-front audio signal R. The amplifying section 10 amplifies audio signals of respective channels, and the speaker output terminal 11 outputs the amplified audio signals to the ZONE2 speaker 40 for the respective channels.

The control section 12 is a microcomputer or a CPU that controls the respective sections of the AV amplifier 1 based on operation programs of the AV amplifier 1 stored in a memory (ROM, RAM, or a flash memory). The display section 14 is an LCD or an FL tube that displays an operating state of the AV amplifier 1 (a volume value, a selector and a listening mode). The operating section 15 is an operation button or a remote control transmitter/receiver into which a user's operation is input.

The control section 12 individually selects an audio signal to be output to the main speaker 30 (a main selector) and an audio signal to be output to the ZONE2 speaker 40 (a ZONE2 selector, a ZONE3 selector for a ZONE3) according to a user's operation. That is to say, the audio signal to be output to the main speaker 30 can be made to be different from the audio signal to be output to the ZONE2 speaker 40. For example, a digital audio signal supplied from the BD player 20A or an audio signal based on an analog audio signal supplied from the BD player 20A is output to the main speaker 30. An audio signal based on an analog audio signal supplied from the BD player 20B can be output to the ZONE2 speaker 40.

The control section 12 can also select "SOURCE" as the ZONE2 selector according to a user's operation. The "SOURCE" means that an audio signal (and a video signal if necessary) to be output to the ZONE speaker 40 is made to be the same as an audio signal (and a video signal if necessary) to be output to the main speaker 30. That is to say, the "SOURCE" means that the audio signal from the BD player 20 that is selected by the main selector is output also to the ZONE2 speaker 40. For example, the digital audio signal or the analog audio signal of the BD player 20A is selected as the main selector. When an audio signal based on the digital audio signal or the analog audio signal supplied from the BD player 20A is output to the main speaker 30, the audio signal based on the analog audio signal supplied from the BD player 20A is output also to the ZONE2 speaker 40.

The control section 12 controls the DSP 6 so that one listening mode is selected from a plurality of listening modes according to a user's operation, and an audio process is executed according to the selected listening mode.

The control section 12 controls a selection state of the switch section 16. More specifically, when modes other than the Whole House Mode are selected as the listening mode, the control section 12 causes the switch section 16 to select an analog audio signal supplied from the analog audio selector 4. As a result, without any relation to the audio signal to be output to the main speaker 30, an audio signal selected from the analog audio signals supplied from the BD players 20A and 20B by a user's operation can be output to the ZONE2 speaker 40.

On the other hand, when the Whole House Mode is selected as the listening mode, the control section 12 causes the switch section 16 to select an analog audio signal from the DAC 7 (namely, the DSP 6). As a result, audio signals that are the same as the audio signals (more specifically, the surround left-rear audio signal SBL and the surround right-rear audio signal) to be output to the main speaker 30 are output to the ZONE2 speaker 40. As a result, the audio signal to be output to the main speaker 30 is subject to the audio process in the DSP 6, and the audio signal to be output to the ZONE2 speaker 40 is also subject to the audio process in the DSP 6. Therefore, the audio signal to be output to the main speaker 30 (particularly, the surround left-rear speaker and the surround right-rear speaker) can be prevented from being delayed with respect to the audio signal to be output to the ZONE2 speaker 40.

Figure 4:
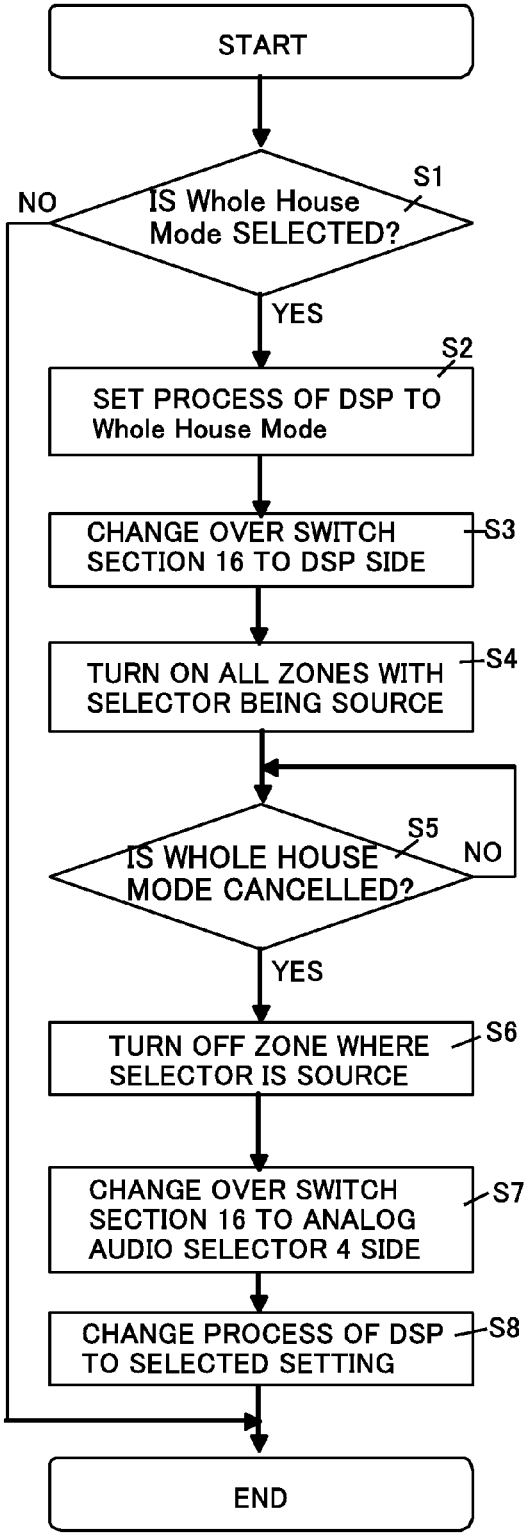
FIG. 4 is a flowchart illustrating a process of a control section 12 of an AV amplifier 1.

An operation of the AV amplifier 1 of the present invention will be described below. FIG. 4 is a flowchart illustrating a process of the control section 12. The control section 12 determines whether the Whole House Mode is selected as the listening mode by the user's operation (S1). When the Whole House Mode is not selected (NO in S1), the process is ended.

When the Whole House Mode is selected (YES in S1), the control section 12 causes the ADC 5 to convert 2-channel analog audio signals (the left-front audio signal L and the right-front audio signal R) to be input into the analog audio selector 3 into digital signals, and to supply the converted signals to the DSP 6. The control section 12 sets the process of the DSP 6 to the process compatible with the Whole House Mode (S2). Therefore, as shown in FIG. 1, the DSP 6 generates the left-front audio signal L, the right-front audio signal R, the central audio signal C, the surround left audio signal SL, the surround right audio signal SR, the lowpass audio signal SW, the surround left-rear audio signal SBL and the surround right-rear audio signal SBR based on 2-channel audio signals including the left-front audio signal L and the right-front audio signal R, and outputs these audio signals to the DAC 7.

The control section 12 switches the switch section 16 to a side of the DSP 6, so as to cause the switch section to select the audio signals (the surround left-rear audio signal SBL and the surround right-rear audio signal SBR) supplied from the DAC 7 (S3). Further, the control section 12 selects the "SOURCE" as all the ZONE selectors, and puts ZONE functions into an ON state (S4). "The ON state of the ZONE function" means that the state that the audio signal is capable of being output from the speaker output terminal 11 for ZONE is set. Therefore, the surround left-rear audio signal SBL and the surround right-rear audio signal SBR in the analog audio signals of plural channels DA-converted by the DAC 7 are supplied to the amplifying section 10 via the switch section 16. The amplifying section 10 amplifies the supplied surround left-rear audio signal SBL and surround right-rear audio signal SBR, and outputs the amplified signals to the ZONE2 speaker 40 via the speaker output terminal 11.

At this time, for the main speaker 30, the amplifying section 8 amplifies the left-front audio signal L, the right-front audio signal R, the central audio signal C, the surround left audio signal SL, the surround right audio signal SR, the lowpass audio signal SW, the surround left-rear audio signal SBL and the surround right-rear audio signal SBR supplied from the DAC 7, and outputs these signals to the main speaker 30 via the speaker output terminal 9. The same audio signals are supplied to the main speaker 30 and the ZONE2 speaker 40. The audio signal to be output to the main speaker 30 is subject to the audio process in the DSP 6, and the audio signal to be output to the ZONE2 speaker 40 is also subject to the audio process in the DSP 6. Therefore, the audio signal to be output to the main speaker 30 can be prevented from being delayed with respect to the audio signal to be output to the ZONE2 speaker 40.

Figure 5:
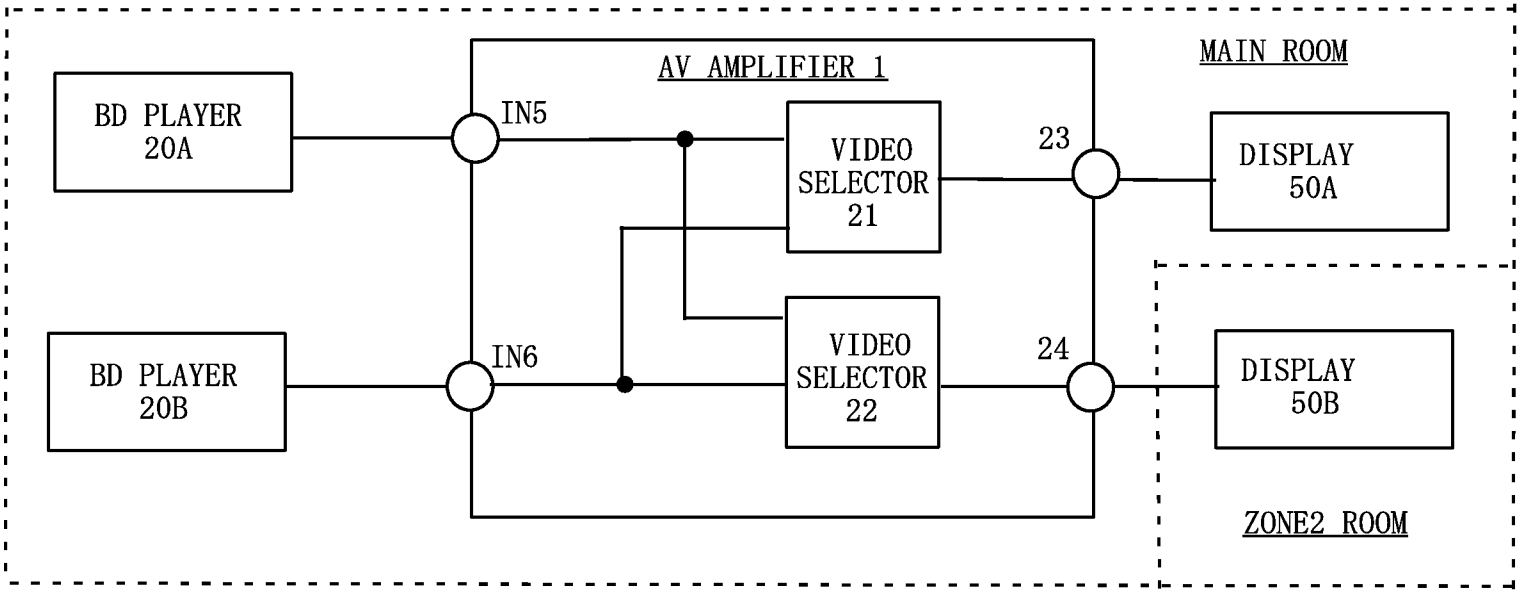
FIG. 5 is a block diagram illustrating a constitution where an attention is paid to a video signal of the AV amplifier 1.

The meaning of the selection of the "SOURCE" as the ZONE2 selector in S4 will be described. As shown in FIG. 5, the actual AV amplifier 1 has video input terminals IN5 and IN6, a video selector 21 for the main room, a video selector 22 for ZONE2, a video output terminal 23 for the main room, and a video output terminal 24 for ZONE2. The AV amplifier 1 receives a video signal from the BD player, and supplies the received video signal to display devices 50A and 50B. When the "SOURCE" is selected as the ZONE2 selector, not only an audio signal but also a video signal to be output from the video signal output terminal 24 for ZONE2 can be the same as a video signal to be output from the video output terminal 23 for the main room.

In the Whole House Mode, when modes other than the "SOURCE" is selected as the ZONE selector by a user's operation, that ZONE withdraws from the Whole House Mode, and the switch section 16 selects not the DAC 7 but the analog audio selector 4 for that ZONE. Therefore, not limited to the audio signal that is the same as that in the main room but any audio signal selected by a user's operation is reproduced for that ZONE. Thereafter, when the "SOURCE" is further selected as the ZONE selector, that ZONE returns to the Whole House Mode, and the switch section 16 again selects the DAC 7 for that ZONE.

The control section 12 determines whether the Whole House Mode is cancelled by a user's operation (S5). For example, when the mode is changed into another listening mode, the determination is made that the Whole House Mode is cancelled. When the Whole House Mode is cancelled (YES in S5), the control section 12 puts all the ZONE functions where the "SOURCE" is selected as the ZONE selector into an OFF state (S6). "To bring the ZONE functions into the OFF state" means that the state that the audio signal is not output from the audio output terminal for ZONE is set. For example, when ZONE2, ZONE3 and ZONE4 are present and "SOURCE" is selected in ZONE2 and ZONE3 as the ZONE selectors, the functions of ZONE2 and ZONE3 are put into the OFF state. Since an audio signal different from that in the main room might be reproduced in ZONE4, the function of ZONE4 is not put into the OFF state. As a result, the reproduction of the audio signal in ZONE4 can be prevented from being stopped despite the intension of the user.

The control section 12 switches the switch section 16 into the side of the analog audio selector 4, and causes the switch section 16 to select the audio signal supplied from the analog audio selector 4 (S7). The control section 12 sets the process of the DSP 6 to a process compatible with the selected listening mode (S8). As a result, the reproduction of an audio signal in the Whole House Mode is ended.

According to this embodiment, the audio signal to be output to the main speaker 30 can be prevented from being delayed with respect to the audio signal to be output to the ZONE2 speaker 40.

Figure 6:
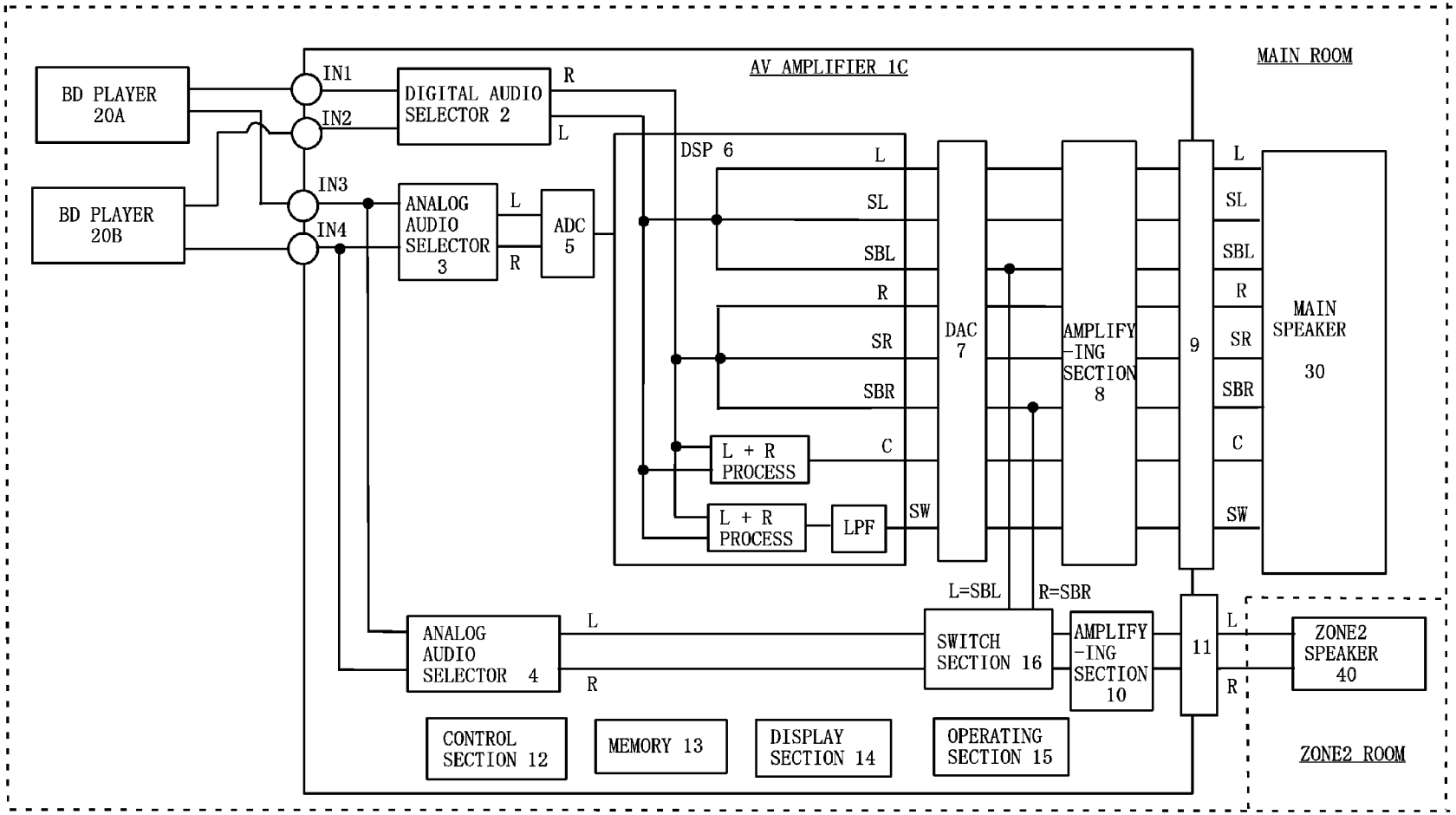
FIG. 6 is a block diagram illustrating a constitution of the AV amplifier 1C according to the preferred embodiment of the present invention.

Another preferred embodiment of the present invention will be described below. FIG. 6 is a diagram illustrating an AV amplifier 1C according this embodiment. In comparison with the AV amplifier 1 in FIG. 1, the AV amplifier 1C inputs 2-channel digital audio signals (the left-front audio signal L and the right-front audio signal) into the digital audio selector 2. The AV amplifier 1C supplies the audio signals to the DSP 6. The DSP 6 generates 7.1-channel audio signals including the left-front audio signal L, the right-front audio signal R, the central audio signal C, the surround left audio signal SL, the surround right audio signal SR, the lowpass audio signal SW, the surround left-rear audio signal SBL and the surround right-rear audio signal SBR based on the left-front audio signal L and the right-front audio signal R supplied from the digital audio selector 2, and outputs these signals to the DAC 7. Since the other parts of the constitution are the same as those of the AV amplifier 1, the description thereof is employed. In this example, when 3 or more-channel (for example, 5.1-channel or 7.1-channel) audio signals are input into the digital audio selector 2, the DSP 6 uses only the 2-channel digital audio signals (the left-front audio signal L and the right-front audio signal), and does not use the residual-channel audio signals.

Figure 7:
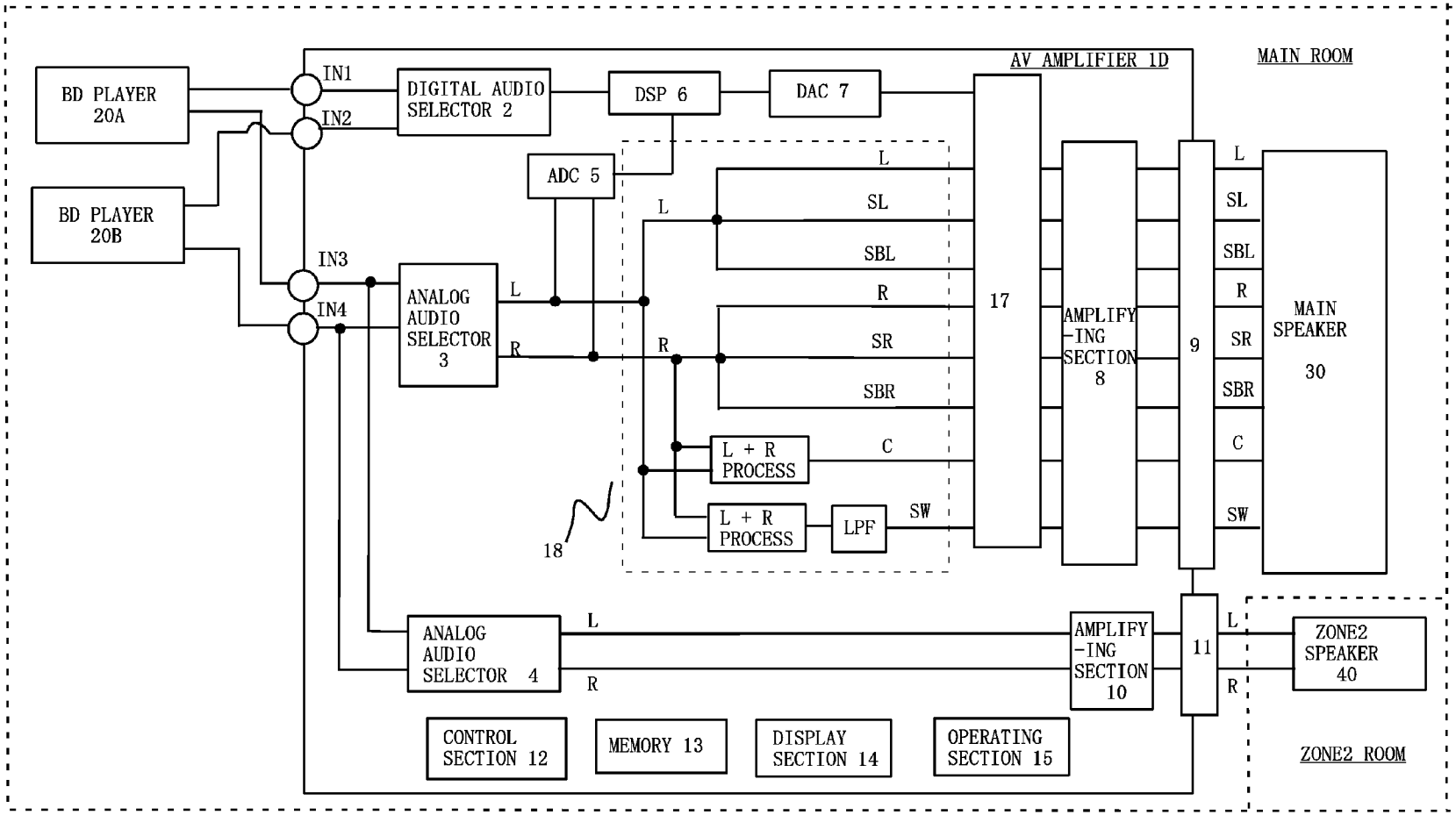
FIG. 7 is a block diagram illustrating a constitution of an AV amplifier 1D according to the preferred embodiment of the present invention.

Still another preferred embodiment of the present invention will be described below. FIG. 7 is a diagram illustrating an AV amplifier 1D according to this embodiment. In comparison with the AV amplifier 1 in FIG. 1, the AV amplifier 1D is provided with a switch section 17 and a multi-channel audio generating section 18. The AV amplifier 1D generates 7.1-channel audio signals based on 2-channel audio signals without using the DSP 6.

The multi-channel audio generating section 18 generates the left-front audio signal L, the right-front audio signal R, the central audio signal C, the surround left audio signal SL, the surround right audio signal SR, the lowpass audio signal SW, the surround left-rear audio signal SBL and the surround right-rear audio signal SBR based on the left-front audio signal L and the right-front audio signal R supplied from the analog audio selector 3 in the Whole House Mode instead of the DSP 6, and outputs these signals to the switch section 17.

The switch section 17 switches between the supply of the audio signals from the DSP 6 (DAC 7) to the amplifying section 8 and the supply of the audio signals from the multi-channel audio generating section 18 to the amplifying section 8. In the listening modes other than the Whole House Mode, the switch section 17 supplies the audio signal from the DSP 6 to the amplifying section 8, and in the Whole House Mode, the switch section 17 supplies the audio signals from the multi-channel audio generating section 18 to the amplifying section 8.

The AV amplifier 1C does not have the switch section 16 of the AV amplifier 1 in FIG. 1. In the Whole House Mode, the analog audio selectors 3 and 4 select the same analog audio signals (the left-front audio signal L and the right-front audio signal R). The left-front audio signal L and the right-front audio signal R from the analog audio selector 4 are supplied to the amplifying section 10 for ZONE2. In the Whole House Mode, since the multi-channel audio generating section 18 generates the 7.1-channel audio signals without via the DSP 6 on the main room side, the audio signal for the main room is not delayed with respect to the audio signal on the ZONE2 side.

Figure 8:
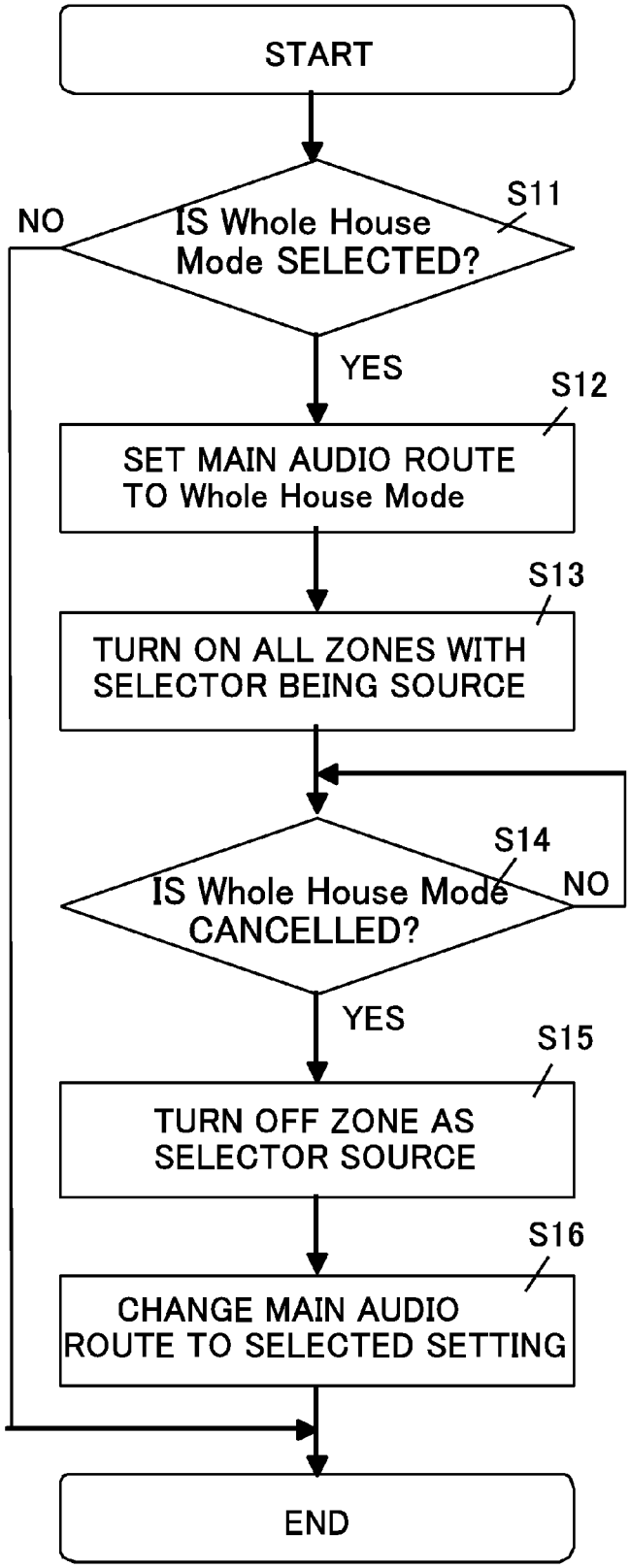
FIG. 8 is a flowchart illustrating the process of the control section 12 of the AV amplifier 1D.

FIG. 8 is a flowchart illustrating an operation of the embodiment. The control section 12 determines whether the Whole House Mode is selected as the listening mode by a user's operation (S11). When the Whole House Mode is not selected (NO in S11), the process is ended.

When the Whole House Mode is selected (YES in S11), the control section 12 causes the analog audio selector 3 to select the analog audio signals (the left-front audio signal L and the right-front audio signal R), and to supply the signals to the multi-channel audio generating section and the ADC 5. The control section 12 switches the audio route of the main room into the route for the Whole House Mode (S12). That is to say, the control section 12 causes the switch section 17 to select the side of the multi-channel audio generating section 18, and to supply the audio signal from not the DSP 6 but the multi-channel audio generating section 18 to the amplifying section 8. The control section 12 selects "SOURCE" as the ZONE selector, and puts all the ZONE functions into an ON state (S13). As a result, the control section 12 makes the analog audio signals (the left-front audio signal L and the right-front audio signal R) selected by the analog audio selector 4 to be identical to analog audio signals (the left-front audio signal L and the right-front audio signal R) selected by the analog audio selector 3. For example, when the analog audio selector 3 selects the analog audio input terminal IN3 (BD player 20A), the analog audio selector 4 also selects the analog audio input terminal IN3 (BD player 20A).

The multi-channel audio generating section 18 generates the left-front audio signal L, the right-front audio signal R, the central audio signal C, the surround left audio signal SL, the surround right audio signal SR, the lowpass audio signal SW, the surround left-rear audio signal SBL and the surround right-rear audio signal SBR based on the left-front audio signal L and the right-front audio signal R, and outputs these signals to the amplifying section 8. The process for generating the surround audio signals is equivalent to the software process of the DSP 6 in the AV amplifier 1 shown in FIG. 1. The amplifying section 8 amplifies the left-front audio signal L, the right-front audio signal R, the central audio signal C, the surround left audio signal SL, the surround right audio signal SR, the lowpass audio signal SW, the surround left-rear audio signal SBL and the surround right-rear audio signal SBR supplied from the multi-channel audio generating section 18, and outputs the amplified signals to the main speaker 30 via the speaker output terminal 9.

The analog audio selector 4 supplies the selected left-front audio signal L and right-front audio signal R to the amplifying section 10. The amplifying section 10 amplifies the supplied left-front audio signal L and the right-front audio signal R, and outputs these signals to the ZONE2 speaker 40 via the speaker output terminal 11. In such a manner, the same audio signals are output to the main speaker 30 and the ZONE2 speaker 40. Both the audio signal to be output to the main speaker 30 and the audio signal to be output to the ZONE2 speaker 40 are not subject to the audio process in the DSP 6. Therefore, the audio signal to be output to the main speaker 30 can be prevented from being delayed with respect to the audio signal to be output to the ZONE2 speaker 40.

Thereafter, the control section 12 determines whether the Whole House Mode is cancelled according to a user's operation (S14). When the Whole House Mode is cancelled (YES in S14), the control section 12 puts all the ZONE functions where "SOURCE" is selected as the ZONE selector into the OFF state (S15).

The control section 12 switches the audio route for the main room into a route compatible with the selected listening mode (S16). That is to say, the control section 12 sets the process of the DSP 6 to a process compatible with the listening mode, and causes the switch section 17 to select the DSP 6 side. Therefore, the DSP 6 executes the audio process on the audio signal supplied from the digital audio selector 2 or the analog audio selector 3, and supplies the processed audio signal to the amplifying section 8 via the switch section 17.

When the ZONE2 functions are turned ON in modes other than the Whole House Mode, the analog audio selector 4 selects the analog audio signals (the left-front audio signal L and the right-front audio signal R) selected by the user's operation without any relation to the audio signal for the main room, and supplies the selected signals to the amplifying section 10.

Figure 9:
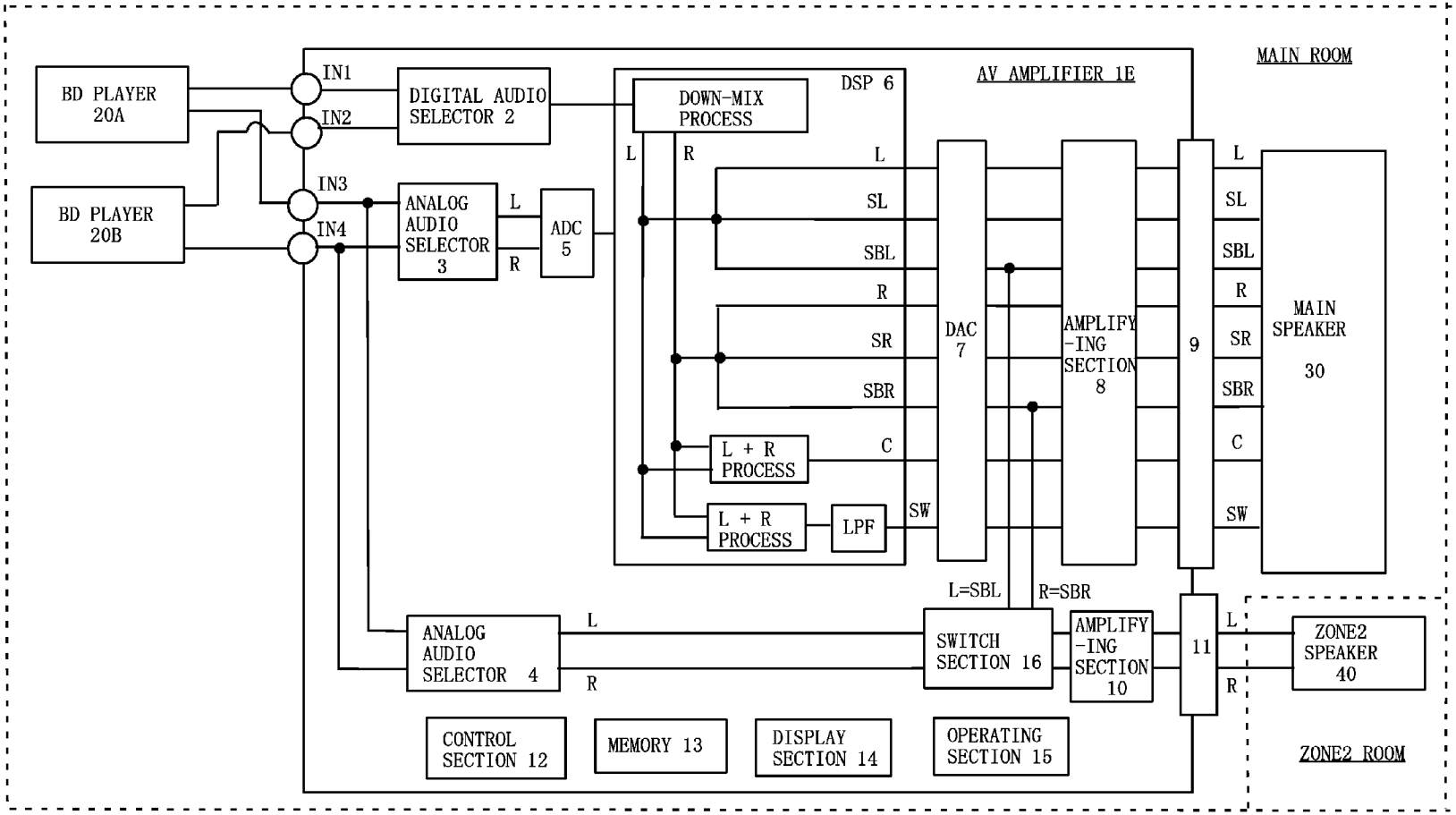
FIG. 9 is a block diagram illustrating a constitution of an AV amplifier 1E according to the preferred embodiment of the present invention.

Still another preferred embodiment of the present invention will be described below. FIG. 9 is a diagram illustrating an AV amplifier 1E according to this embodiment. In comparison with the AV amplifier 1C in FIG. 6, in the AV amplifier 1E, the digital audio selector 2 selects 3 or more-channel (for example, 5.1-channel or 7.1-channel) digital audio signals, and supplies the signals to the DSP 6. In the Whole House Mode, the DSP 6 executes a down-mix process on the supplied three or more-channel digital audio signals so as to generate 2-channel audio signals (the left-front audio signal L and the right-front audio signal R). Similarly to the AV amplifier 1C, the DSP 6 generates the left-front audio signal L, the right-front audio signal R, the central audio signal C, the surround left audio signal SL, the surround right audio signal SR, the lowpass audio signal SW, the surround left-rear audio signal SBL and the surround right-rear audio signal SBR based on the left-front audio signal L and the right-front audio signal R, and outputs these signals to the DAC 7.

Figure 10:
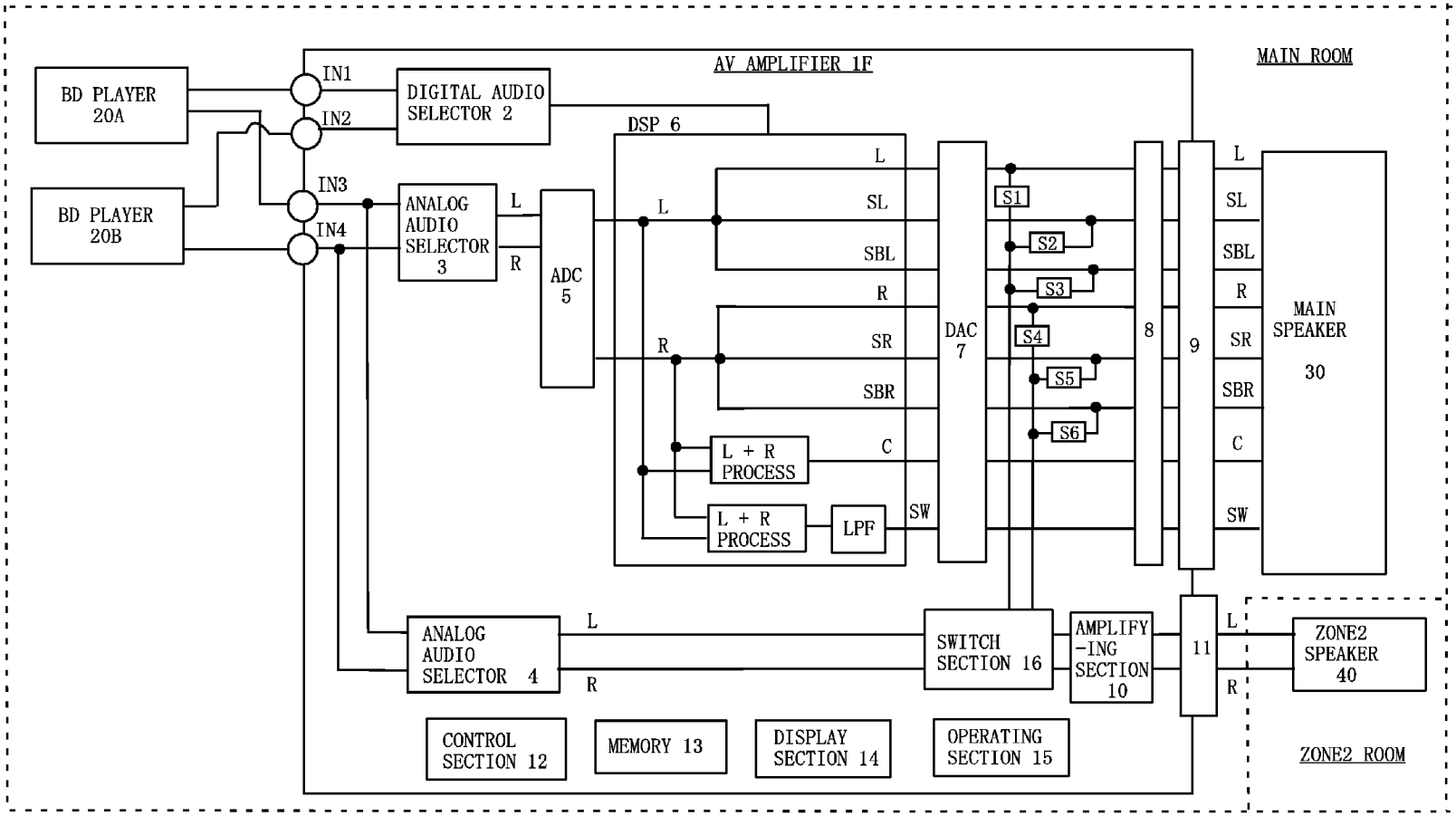
FIG. 10 is a block diagram illustrating a constitution of an AV amplifier 1F according to the preferred embodiment of the present invention.
Figure 11:
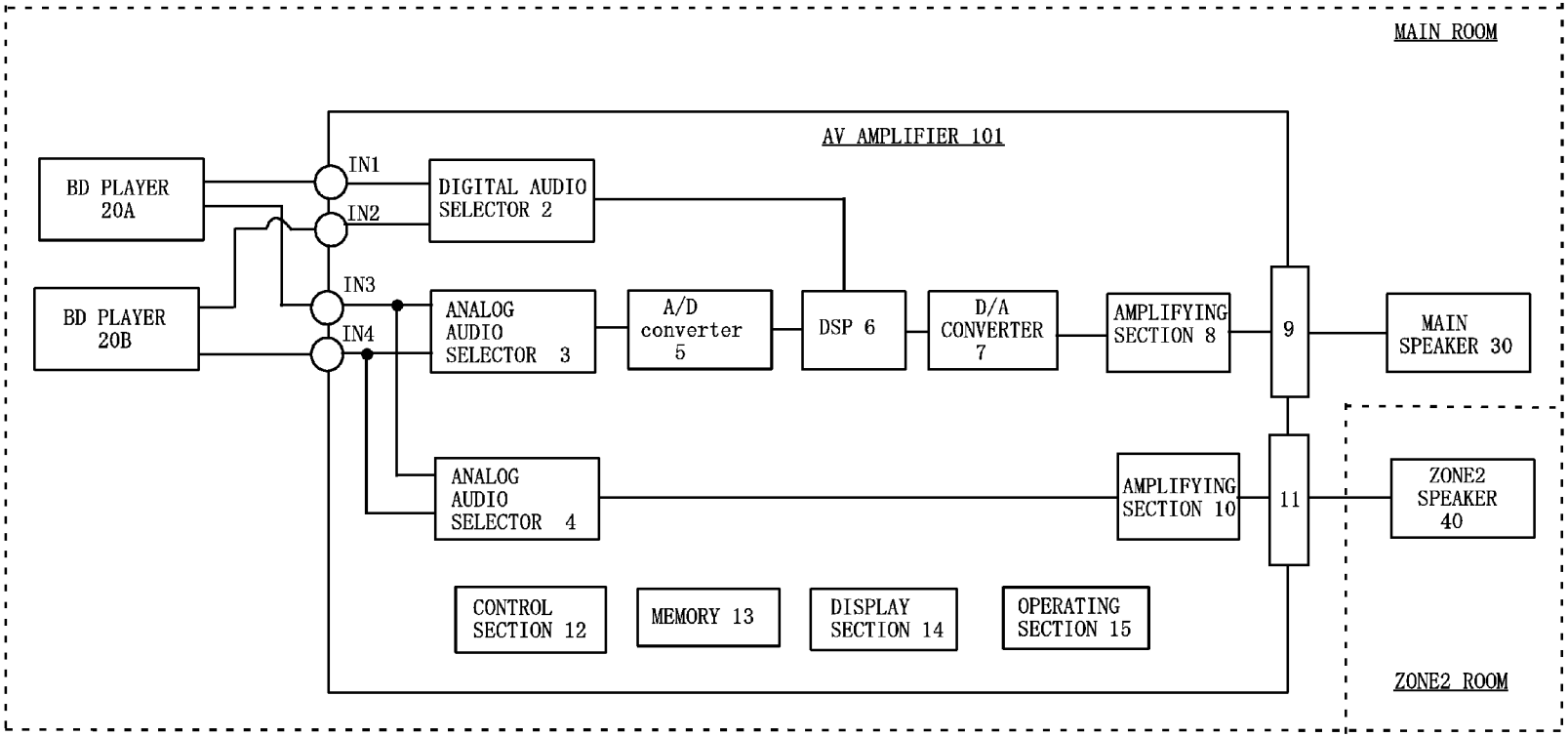
FIG. 11 is a block diagram illustrating a constitution of a conventional AV amplifier 101.

Still another preferred embodiment of the present invention will be described below. FIG. 10 is a diagram illustrating an AV amplifier 1F according to this embodiment. In comparison with FIG. 1 and FIG. 3, the AV amplifier 1F has switches S1 to S6. ON/OFF states of the switches S1 to S6 are controlled by the control section 12. One combination is selected from a combination of the left-front audio signal L and the right-front audio signal R, a combination of the surround left audio signal SL and the surround right audio signal, and a combination of the surround left-rear audio signal and the surround right-rear audio signal according to a user's operation, and the selected combination is supplied to the switch section 16. Therefore, the user can suitably change a combination of audio signals to be output to the ZONE2 speaker according to a position of the ZONE2 room speaker 40.

The preferred embodiments of the present invention are described above, but the present invention is not limited to these embodiments. For example, the AV amplifier 1 is provided with pre-out output terminals for the main room and/or the ZONE2, and analog audio signals before amplification by the amplifying section 8 and the amplifying section 9 may be output from the pre-out output terminals. In this case, the amplifying section is additionally connected to a front stage of the main speaker 30 and/or the ZONE2 speaker 40, or a speaker containing the amplifying section is used as the main speaker 30 and/or the ZONE2 speaker 40. The digital audio input terminals IN1 and IN2 may be HDMI input terminals that receive HDMI data including video data and audio data, or input terminals of another standard. Instead of the BD player, another contents reproducing apparatuses such as a DVD player, a CD player, and a game machine may be used. Further, in the above embodiments, the DSP 6 or the multi-channel audio generating section 18 generates the 7.1-channel audio signal, but the present invention is not limited to this, and it may generate at least 4-channel audio signals (a first left audio signal, a first right audio signal, a second left audio signal, and a second right audio signal). Further, a program for causing a computer to execute the process in the control section 12 of the AV amplifier 1, and a recording medium that records the program therein may be provided.

What is claimed is:

1. An audio processing apparatus, comprising:

a mode selecting section for selecting one mode from a plurality of modes including a first mode according to a user's operation;

a plurality of audio input terminals;

a first output terminal for outputting audio signals to a first multi-speaker arranged in a first room;

a second output terminal for outputting audio signals to a second multi-speaker arranged in a second room;

a first selecting section for selecting one audio signal from audio signals input into the plurality of audio input terminals and supplying the selected audio signal to an audio processing section;

a second selecting section for selecting one audio signal from the audio signals input into the plurality of audio input terminals and supplying the selected audio signal to a third selecting section;

the audio processing section for generating at least a first left audio signal, a first right audio signal, a second left audio signal that is the same as the first left audio signal, and a second right audio signal that is the same as the first right audio signal based on the selected audio signal supplied from the first selecting section so as to output the first left audio signal, the first right audio signal, the second left audio signal and the second right audio signal to the first output terminal, and supplying the second left audio signal and the second right audio signal to the third selecting section;

the third selecting section for selecting between the selected audio signal from the second selecting section and the second left audio signal and the second right audio signal from the audio processing section, and outputting the selection to the second output terminal; and a control section for, when the first mode is selected, causing the third selecting section to select the second left audio signal and the second right audio signal from the audio processing section, and when modes other than the first mode are selected, causing the third selecting section to select the audio signal from the second selecting section.

2. The audio processing apparatus according to claim 1, wherein:

the control section associates a respective audio selection with each of the first room and the second room based on user's operation, the audio selection being selected from among a source audio selection and an audio selection other than the source audio selection;

when the first mode is selected, the source audio selection is selected automatically for both the first room and the second room;

when the first mode is selected and the audio selection for the second room is changed into an audio selection other than the source audio selection by a user's operation, a mode other than the first mode is automatically selected and the third selecting section selects the audio signal from the second selecting section, and when the audio selection for the second room is again changed to the source audio selection by a user's operation, the first mode is automatically selected and the third selecting section again selects the audio signal from the audio processing section;

when the selection of the first mode is cancelled and the audio selection for the second room is the source audio selection, a state where an audio signal is not output from the second output terminal is set, and when the selection of the first mode is cancelled and the audio selection for the second room is a an audio selection other than the source audio selection, a state where an audio signal is output from the second output terminal is maintained.

3. An audio processing apparatus, comprising:

a mode selecting section for selecting one mode from a plurality of modes including a first mode according to a user's operation;

a plurality of audio input terminals;

a first output terminal for outputting audio signals to a first multi-speaker arranged in a first room;

a second output terminal for outputting audio signals to a second multi-speaker arranged in a second room;

a first selecting section for selecting one audio signal from audio signals input into the plurality of audio input terminals, and supplying the selected audio signal to an audio processing section;

a second selecting section for selecting one audio signal from the audio signals input into the plurality of audio input terminals, and supplying the selected audio signal to a third selecting section;

the audio processing section for generating at least a first left audio signal, a first right audio signal, a second left audio signal that is the same as the first left audio signal, and a second right audio signal that is the same as the first right audio signal based on the selected audio signal supplied from the first selecting section so as to output the first left audio signal, the first right audio signal, the second left audio signal and the second right audio signal to the first output terminal, and supplying the first left audio signal and the first right audio signal to the third selecting section;

the third selecting section for selecting between the selected audio signal from the second selecting section and the first left audio signal and the first right audio signal from the audio processing section, and outputting the selection to the second output terminal; and a control section for, when the first mode is selected, causing the third selecting section to select the first left audio signal and the first right audio signal from the audio processing section, and when modes other than the first mode are selected, causing the third selecting section to select the audio signal from the second selecting section.

4. The audio processing apparatus according to claim 3, wherein:

the control section associates a respective audio selection with each of the first room and the second room based on user's operation, the audio selection being selected from among a source audio selection and an audio selection other than the source audio selection;

when the first mode is selected, the source audio selection is selected automatically for both the first room and the second room;

when the first mode is selected and the audio selection for the second room is changed into an audio selection other than the source audio selection by a user's operation, a mode other than the first mode is automatically selected and the third selecting section selects the audio signal from the second selecting section, and when the audio selection for the second room is again changed to the source audio selection by a user's operation, the first mode is automatically selected and the third selecting section again selects the audio signal from the audio processing section;

when the selection of the first mode is cancelled and the audio selection for the second room is the source audio selection, a state where an audio signal is not output from the second output terminal is set, and when the selection of the first mode is cancelled and the audio selection for the second room is a an audio selection other than the source audio selection, a state where an audio signal is output from the second output terminal is maintained.

5. An audio processing apparatus, comprising:

a mode selecting section for selecting one mode from a plurality of modes including a first mode according to a user's operation;

a plurality of audio input terminals;

a first output terminal for outputting a-n-audio signals to a first multi-speaker arranged in a first room;

a second output terminal for outputting a-a-audio signals to a second multi-speaker arranged in a second room;

an audio processing section for executing an audio process on a supplied audio signal;

a first selecting section for selecting one audio signal from audio signals input into the plurality of audio input terminals;

a multi-channel audio generating section for generating at least a first left audio signal, a first right audio signal, a second left audio signal that is the same as the first left audio signal, and a second right audio signal that is the same as the first right audio signal based on the selected audio signal supplied from the first selecting section, and outputting the first left audio signal, the first right audio signal, the second left audio signal and the second right audio signal to a third selecting section;

a second selecting section for selecting one audio signal from the audio signals input into the plurality of audio input terminals, and outputting the selected audio signal to the second output terminal;

the third selecting section for switching whether the processed audio signal from the audio processing section is output to the first output terminal or the first left audio signal, the first right audio signal, the second left audio signal and the second right audio signal from the multi-channel audio generating section are output to the first output terminal; and a control section for, when the first mode is selected, causing the first selecting section and the second selecting section to select the same audio signals and causing the third selecting section to output the first left audio signal, the first right audio signal, the second left audio signal and the second right audio signal from the multi-channel audio generating section to the first output terminal, and when modes other than the first mode are selected, causing the third selecting section to output the processed audio signal from the audio processing section to the first output terminal.

* * * * *